US008156571B2

(12) United States Patent
Barzilla

(10) Patent No.: US 8,156,571 B2
(45) Date of Patent: Apr. 17, 2012

(54) BASEBALL GLOVE WITH INDICIA APPARATUS

(76) Inventor: Phillip Barzilla, Sugar Land, TX (US)

( * ) Notice: Subject to any disclaimer, the term of this patent is extended or adjusted under 35 U.S.C. 154(b) by 71 days.

(21) Appl. No.: 12/804,596

(22) Filed: Jul. 26, 2010

(65) Prior Publication Data

US 2012/0017344 A1 Jan. 26, 2012

(51) Int. Cl.
*A41D 13/08* (2006.01)

(52) U.S. Cl. ..... 2/19

(58) Field of Classification Search ..... 2/19, 16, 2/160, 161.1, 161.2; 273/371.6
See application file for complete search history.

(56) References Cited

U.S. PATENT DOCUMENTS 1,612,055 A * 12/1926 Rice ..... 2/160
2,103,711 A * 12/1937 Cole ..... 2/160
3,214,852 A * 11/1965 Ford et al. ..... 40/640
3,543,977 A * 12/1970 Lockridge ..... 224/222
3,965,488 A * 6/1976 Paulucci ..... 2/160
4,805,242 A * 2/1989 Bolton ..... 2/160
5,170,917 A * 12/1992 Tourigny ..... 224/221
5,400,936 A * 3/1995 Jones et al. ..... 224/222
5,425,142 A * 6/1995 Scott ..... 2/19
5,477,633 A * 12/1995 Leinberger ..... 40/661
5,584,133 A * 12/1996 Motooka et al. ..... 40/642.02
5,659,899 A * 8/1997 Soter et al. ..... 2/160
5,704,067 A * 1/1998 Brady ..... 2/170
D438,374 S * 3/2001 Hayman ..... D3/215
6,651,368 B1 * 11/2003 Blanks ..... 40/649
6,979,198 B2 * 12/2005 Krieger ..... 434/156
D585,161 S * 1/2009 Aoki et al. ..... D29/123

* cited by examiner

*Primary Examiner* — Danny Worrell
(74) *Attorney, Agent, or Firm* — Kenneth D. Bauch

(57) ABSTRACT

A baseball glove 10 is provided with an indicia apparatus 12 which allows the user to view recorded data when desired. The baseball glove 10 includes a transparent member 34 which is coupled to and spaced from the back wall 14 of the glove so that an accessible open area 36 is formed between the wall and transparent member. A first planar shaped member 42 is provided having predetermined recorded indicia 44 thereon which is slidably held under the transparent member 34 so that the indicia thereon is visible. A second planer shaped member 46 is coupled to the glove above and adjacent the transparent member 34 so that it can be pivoted to conceal or reveal the recorded indicia on the transparent member as desired. A coupling member 50 is provided so that the second planar shaped member 46 can be coupled to cover the transparent member 34 and conceal the recorded indicia 44 when desired.

10 Claims, 3 Drawing Sheets

BASEBALL GLOVE WITH INDICIA APPARATUS

TECHNICAL FIELD

This invention relates to a baseball glove and more particularly to a baseball glove for providing a user with information to be used during the course of a baseball game. Success in baseball as well as other sports requires that a participant has a competitive edge that will enhance the participants chance of being successful. Being ready to compete is an on going concern. This concern can be addressed by a player having access to certain kinds of information prior to and during the game. Such activities as studying scouting reports of the opposition is a necessary part of the pregame preparation. Scouting reports given to pitchers and fielders about the tendencies of opposing batters are very important. Such information as a hitters inability to hit a fastball or a hitters tendency to pull or hit the ball to a certain part of the field is valuable information. This information is normally provided before the game so that it can to be studied. However, it is desirable that an apparatus be provided so that access to such information is available during the game.

BACKGROUND ART

There have been a number of attempts to provide the information to a player that is needed to be successful during a game. One of these efforts specifically deals with scouting reports that are provided to a player to be studied before the game. Retention of this information during the game can be a challenge given the number of games that are played, the frequency of these games, and the frequency of receiving new information.

To assist with this challenge, a frequent method used for providing players with information needed during the game is a somewhat elaborate system of hand signals that communicates information about opposing players, tendencies, weaknesses and strengths. This is a very helpful tool, however it does require the participation of others, most of whom are not on the field when disseminating the information. There is no tool available that provides information to players that the player can access while playing the game without involvement from another player or coach. Such a tool however would be desirable.

DISCLOSURE OF THE INVENTION

A baseball glove of this invention is provided with an indicia apparatus which allows a player to access recorded data during the game. The baseball glove of this invention includes a transparent member which is spaced from and coupled to a back wall of the glove just above a wrist area of the glove so that a longitudinally extending open area is formed between the wall and transparent member and so that an opening is formed allowing access to the open area. A first planar shaped member is provided having predetermined recorded indicia thereon which is slidably mounted in and held between the transparent member and the glove wall so that the indicia thereon is visible through the transparent member. A second planer shaped member is provided and coupled to the glove above and adjacent to the transparent member so that it can be selectively pivoted to a first position to conceal the indicia on the first planar shaped member and to a second position to reveal the indicia on the first planar shaped member. A coupling member is provided having portions thereof formed on the transparent member and glove wall and other portions formed on the second planar shaped member so that the second planar shaped member can be selectively coupled in place to cover the transparent member.

BRIEF DESCRIPTION OF THE DRAWING

The details of the invention will be described in connection with the accompanying drawing in which.

BEST MODE FOR CARRYING OUT THE INVENTION

Figure 1:
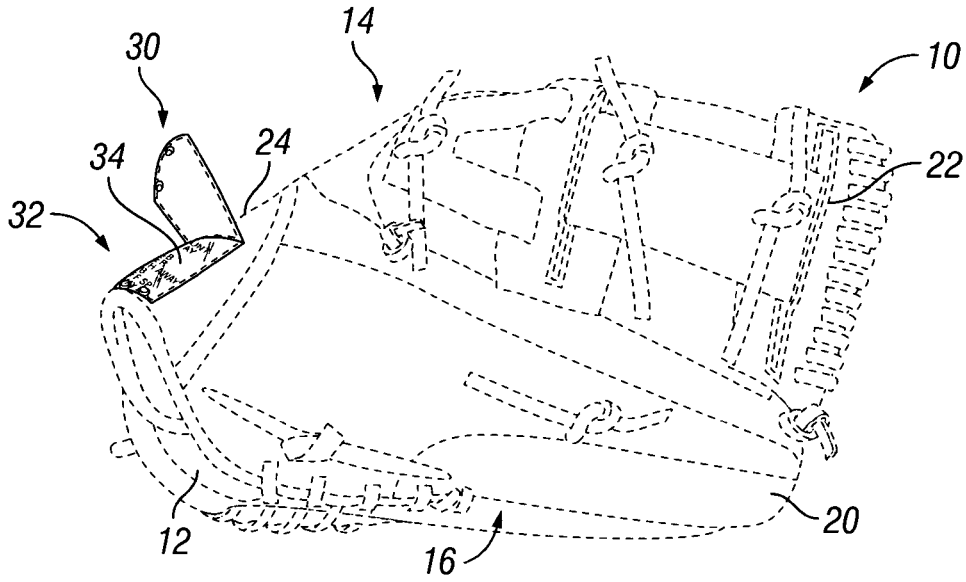
FIG. 1 is a side perspective view illustrating a baseball glove provided with the indicia apparatus in accordance with the principles of the invention.
Figure 2:
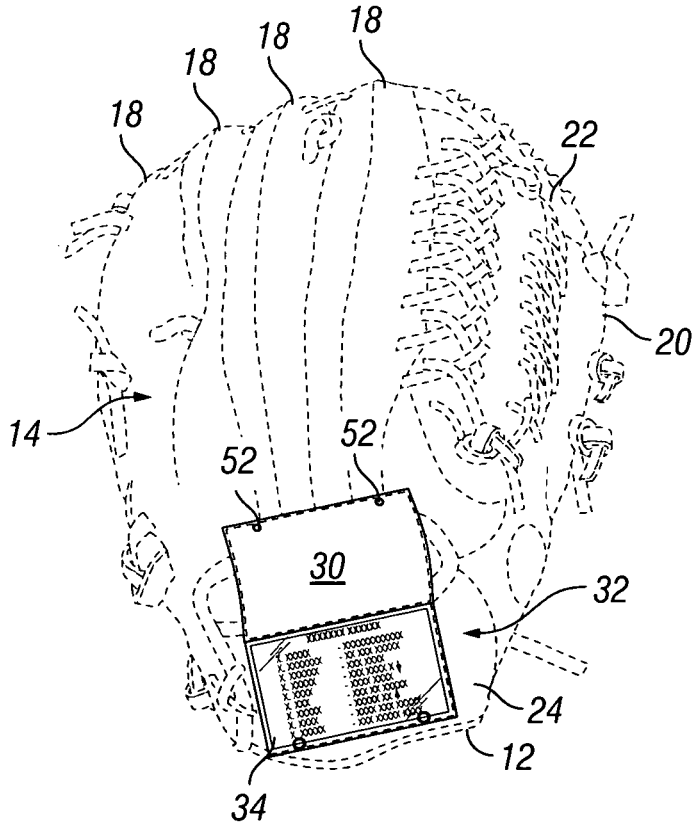
FIG. 2 is a back perspective view illustrating a baseball glove provided with the indicia apparatus in accordance with the principles of the invention.
Figure 3:
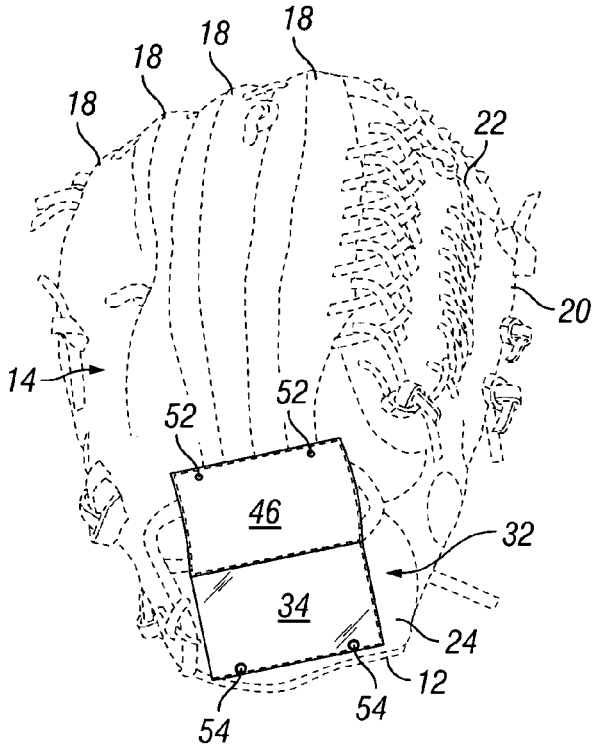
FIG. 3 is a back perspective view illustrating a baseball glove provided with the indicia apparatus with the indicia recorded member removed in accordance with the principles of the invention.
Figure 4:
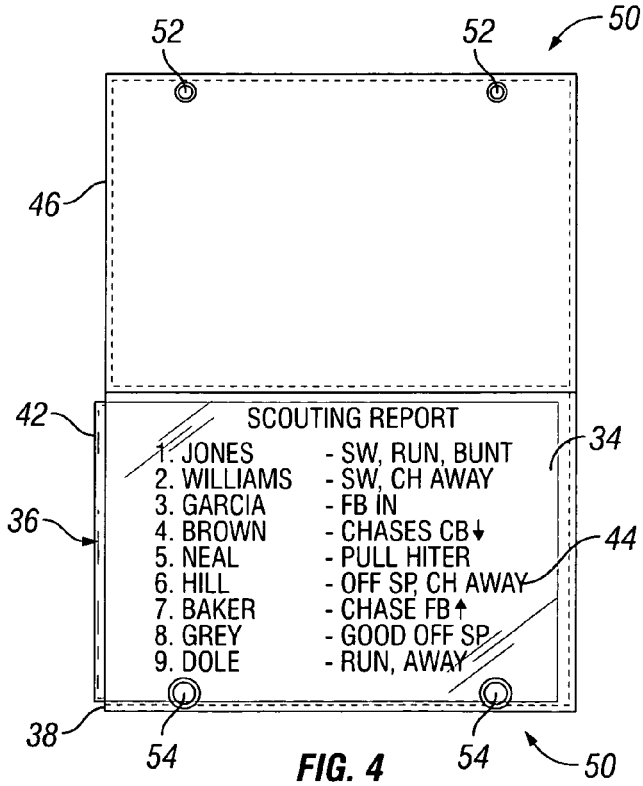
FIG. 4 is a front view illustrating an indicia apparatus in accordance with the principles of the invention.
Figure 5:
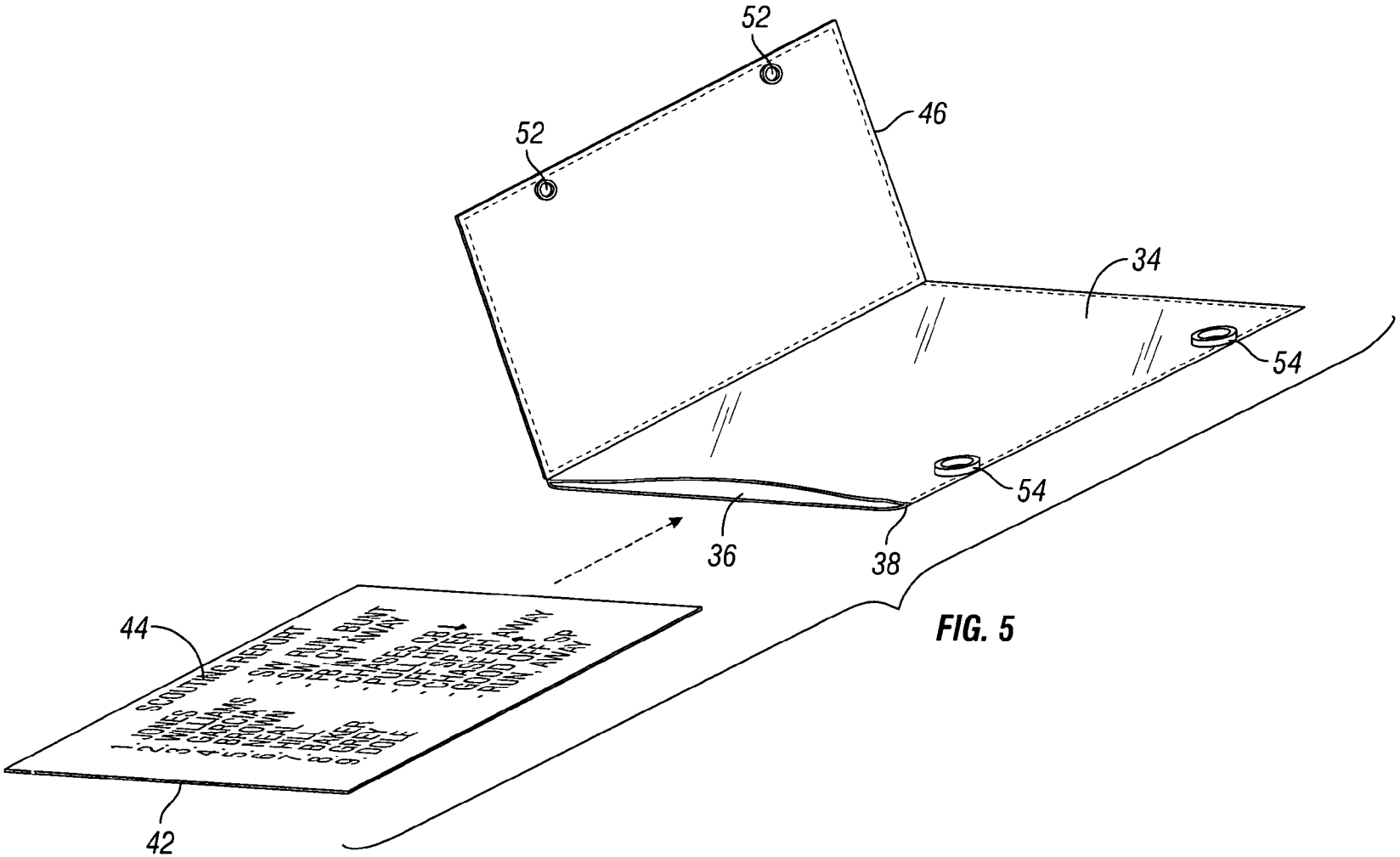
FIG. 5 is a perspective exposed view illustrating an indicia apparatus in accordance with the principles of the invention.

Referring to FIGS. 1 and 2 there is shown a baseball glove, generally designated, by the numeral, 10. The baseball glove 10 is provided for use on a hand 12 (only partially shown) of a player (not shown). The baseball glove 10, which is of a conventional construction, includes back and inside wall members, generally designated, by the numerals, 14 and 16 respectively. The back and inside wall members 14 and 16 are made in a conventional configuration to form finger slots 18 which receive the fingers of a player therein, a thumb slot 20 which receives the players thumb and a web member 22 coupled between the finger slot closest the thumb slot and the thumb slot. This glove construction allows a user's hand to be inserted into the glove 10 for use of the glove in a well known manner.

The baseball glove 10 of this invention is provided with an indicia apparatus, generally designated, by the numeral, 30 which allows the user to view recorded indicia or data when desired, such as, for example, scouting reports and others materials for giving a player a competitive edge while playing. The indicia apparatus 30 includes a pocket member, generally designated, by the numeral, 32. The pocket member 32 is formed on a back wall member 14 of the glove 10 just above a wrist area 24 of the glove. The baseball glove 10 also includes a transparent member 34 which is coupled to and spaced from the back wall 14 of the glove 10. As a result access to a longitudinally extending rectangularly shape open area 36 is formed between the back wall 14 and transparent member 34 at an end 38 thereof.

A first planar shaped member or card 42 having predetermined recorded indicia 44 thereon, such as, for example, written indicia, or even photographic indicia, which provides information to the user is also provided. The first planar shaped member 42 is slidably mounted and held in the pocket member 32 so that the indicia 44 thereon is visible. A second planer shaped cover member 46 is provided and coupled to the glove 10 so that it can be aligned adjacent the transparent member 34 and pivoted to conceal or reveal the recorded indicia 44 as desired. The second planar shaped cover member may be, for example, the same color as, and made of the same material as the glove 10.

The indicia apparatus 30 is also provided with a coupling member, generally designated, by the numeral, 50. The coupling member 50 is provided having snap members 52 formed on the planar shaped member 46 and snap receptors 54 formed on the transparent member 34 and glove 10 so that the planar shaped member 46 can be coupled in place over the transparent member. The coupling member 50 can be a number of different coupling arrangements and, for example, may also be Velcro or other such coupling apparatuses.

When it is desired to use the baseball glove 10 of this invention during a game, a player will put the glove on in the normal manner with the first planar shaped member 42 having the written indicia 44 therein slidably mounted in the pocket 32 under the transparent member 34. The cover member 46 can then be pivoted to reveal the indicia 44 as desired. Once the indicia is revealed and the desired information retrieved the cover member can then be pivoted to cover the indicia 44 and coupled in place by coupling member 50 thereby concealing the indicia. Of course this process of revealing and concealing the indicia 44 is repeated as desired by the user as information is needed during the game.

It should be recognized that a player may also want to access other kinds of information during a game, such as, for example, pictorial information of a family member or other inspirational information that helps a player to participate at the highest level of ones game.

The invention has been shown and described in what is considered to be the most practical and preferred embodiment. However, it should be recognized that changes may be made by those skilled in the art without departing from the spirit of the invention.

What is claimed:

1. A baseball glove having an indicia apparatus including:

a transparent member spaced from and coupled to a lower portion of a back wall of the glove so that a longitudinally extending open area is formed between the wall and transparent member and so that an opening is formed at an end thereof allowing access to the open area;

a first planar shaped member, having predetermined recorded indicia thereon, slidably mounted and held between the transparent member and glove wall so that the recorded indicia thereon is visible through the transparent member;

a second planer shaped member coupled to the glove above and adjacent the transparent member so that said planar shaped member can be selectively pivoted to a first position to conceal the recorded indicia on the first planar shaped member and to a second position to reveal the recorded indicia on the first planar shaped member; and a coupling member having portions thereof formed on the transparent member and the wall of the glove and other portions thereof formed on the second planar shaped member so that the second planar shaped member can be selectively coupled in place to cover the transparent member.

2. A baseball glove as defined in claim 1 wherein the coupling member includes:

a first pair of spaced snap member's formed on the transparent member and the wall of the glove; and a second pair of spaced receptor members formed on the second planar shaped member, each one of the second pair of spaced receptors being aligned to receive one of the snap members to facilitate the coupling of the second planar shaped member in place over the transparent member.

3. A baseball glove as defined in claim 2 wherein the longitudinally extending open area is rectangular in shape and wherein the access opening is formed between the glove wall and a lateral wall of the transparent member.

4. A baseball glove as defined in claim 3 wherein the recorded indicia on the first planar member is written indicia.

5. A baseball glove as defined in claim 3 wherein the recorded indicia on the first planar shaped member is photographic indicia.

6. A method of providing a baseball glove with an indicia apparatus including the steps of:

coupling a transparent member to a lower portion of a back wall of the glove so that a longitudinally extending open area is formed between the wall and transparent member and so that an opening is formed allowing access to the open area;

slidably mounting a first planar shaped member, having predetermined recorded indicia thereon, between the transparent member and glove wall so that the recorded indicia thereon is visible;

coupling a second planer shaped member to the glove wall above and adjacent the transparent member so that the second planar shaped member can be selectively pivoted to a first position to conceal the recorded indicia on the first planar shaped member and to a second position to reveal the recorded indicia on the first planar shaped member; and coupling first portions of a coupling member to the transparent member and the wall of the glove and coupling second portions of the coupling member to the second planar shaped member so that the second planar shaped member can be selectively held in place to cover the transparent member.

7. A method of providing a baseball glove with an indicia apparatus as defined in claim 6 wherein the coupling member includes:

a first pair of spaced snap members formed on the transparent member and the wall of the glove; and a second pair of spaced receptor members formed on the second planar shaped member, each one of the second pair of spaced receptors being aligned with one of the snap members to facilitate the coupling of the second planar shaped member in place over the transparent member.

8. A method of providing a baseball glove with an indicia apparatus as defined in claim 7 wherein the longitudinally extending open area is rectangular in shape and wherein the access opening is formed between the glove wall and a lateral wall of the transparent member.

9. A method of providing a baseball glove with an indicia apparatus as defined in claim 7 wherein the recorded indicia on the first planar shaped member is written indicia.

10. A method of providing a baseball glove with an indicia apparatus as defined in claim 7 wherein the recorded indicia on the first planar shaped member is photographic indicia.

* * * * *